United States Patent [19]

Brettbacher et al.

[11] Patent Number: 4,465,912

[45] Date of Patent: Aug. 14, 1984

[54] COILER-FURNACE COMBINATION

[75] Inventors: Franz Brettbacher, Linz; Karl Moshammer, Leonding; Ernst Rom, St.Veit a.d.Glan; Franz Hirschmanner, Leonding, all of Austria

[73] Assignee: Voest-Alpine Aktiengesellschaft, Linz, Austria

[21] Appl. No.: 397,582

[22] Filed: Jul. 12, 1982

[30] Foreign Application Priority Data

Aug. 24, 1981 [AT] Austria ..... 3670/81

[51] Int. Cl.[3] ..... H05B 5/08

[52] U.S. Cl. ..... 219/10.49 A; 219/10.61 A

[58] Field of Search ..... 219/10.49 A, 10.49 R, 219/10.61 A, 10.61, 10.79, 469, 470; 29/117, 113

[56] References Cited

U.S. PATENT DOCUMENTS

| | | | |
|---|---|---|---|
| 2,273,423 | 2/1942 | Somes | 219/10.49 A |
| 3,006,625 | 10/1961 | Boron | 29/117 |
| 3,857,673 | 12/1974 | Andrus | 219/469 |

FOREIGN PATENT DOCUMENTS

| | | |
|---|---|---|
| 818509 | 12/1951 | Fed. Rep. of Germany . |
| 1427524 | 3/1965 | France . |

*Primary Examiner*—Roy N. Envall, Jr.
*Assistant Examiner*—M. M. Lateef
*Attorney, Agent, or Firm*—Kurt Kelman

[57] ABSTRACT

A coiler-furnace comprises a heat-shielding hood and a coiler having a coiler mandrel for coiling a hot-rolled strip. The mandrel incorporates an electrically energizable heating winding comprising a plurality of inductor coils for heating the coiler strip.

9 Claims, 2 Drawing Figures

COILER-FURNACE COMBINATION

BACKGROUND OF THE INVENTION

This invention relates to a coiler-furnace comprising a coiler having a mandrel disposed within a heat-shielding hood.

To compensate for the heat loss occurring during several passes in a reversing rolling mill stand for hot-rolling strip, coiler-furnaces are provided before and behind the reversing rolling mill stands. These coiler-furnace comprise a heat-shielding hood, into which the mandrel of a coiler protrudes. After a rolling pass, the strip is fed to the coiler-furnace and is usually inserted into a receiving slot of the coiler mandrel when the coiler is at rest. Thereafter, the strip is coiled on the coiler mandrel. Because heat losses are inevitable as the strip is moving slowly during the threading of the leading end of the strip into the coiler mandrel, the strip must have at least a certain minimum thickness and must be accelerated as highly as possible when it has been threaded into the mandrel so that the heat losses will be minimized. But a high acceleration requires suitable drive means as well as an expensive automatic control system for preventing excessively high tensile stresses or a formation of loops.

DESCRIPTION OF THE PRIOR ART

A slow initial feeding of the strip and the disadvantages involved therein can be avoided in accordance with German Patent No. 818,509 by providing pressure rollers which are urged against the coiler mandrel. The strip to be coiled is passed between the pressure rollers and the coiler mandrel so that the strip will be entrained by frictional contact. However, the entraining of the strip will depend on the friction conditions, which are not constant, so that slippage resulting in damage to the strip may occur or the load on the drive means may vary so that an expensive automatic control system is required.

Another serious disadvantage of the coiler-furnaces described above is the fact that they are heated by hot flue gases, which promote undesirable scaling. The scale becomes sandwiched between the convolutions of the coiled strip and is then rolled into the strip so that the surface finish is highly adversely affected. Besides, the sulfur contained in the flue gases attacks the nickel-containing steel of which the coiler mandrel is made so that the latter is liable to fail.

Whereas it has been proposed in French Patent No. 1,427,524 to avoid the conventional coiler-furnaces and to electrically heat the strip by electric current conducted through the strip, e.g., between the coiler and pinch rollers which precede the coiler, that proposal has not been successful because there is no heat insulation so that adequate temperatures cannot be obtained with an economical consumption of energy. Besides, scale due to sparks at the currentfeeding contacts cannot be precluded and the strip cannot be entirely coiled and uncoiled.

SUMMARY OF THE INVENTION

It is an object of the invention to avoid the disadvantages stated hereinbefore and to provide a coiler-furnace which is structurally simple and ensures an indirect heating of the strip so as to avoid scaling and which permits the use of a coiler by which the strip can be coiled without slippage and can be threaded at high speed.

This object is accomplished by the invention with a coiler mandrel which constitutes a heater and carries an electric heating winding consisting of inductor coils.

Since the coiler mandrel heats the coiled strip by heat conducted from the inside, scaling due to elevated temperatures will be precluded. This is also due to the fact that the strip is electrically heated by inductor coils which are surrounded by a layer of electrically conducting material, in which they induce eddy currents by which the coiler mandrel is heated. As a result, heat losses can be avoided to a high degree. Besides, the coiler mandrel has a relatively low heat capacity so that downtimes required for servicing can be minimized.

Because the coiler mandrel constitutes a heater, any uncontrolled heat loading of the coiler mandrel from the outside will be avoided so that even coilers having expanding mandrels can be used in coiler-furnaces. In that case, the heating coil is carried by the expanding segments of the expanding mandrel and each segment constitutes a heater. If expanding mandrels are used in coiler-furnaces, as is possible with the heating system according to the invention, that the strip will be received by the mandrel without slippage and will be wound up at a predetermined velocity because the required frictional contact can always be maintained by the expanding device. This will ensure a uniform velocity of the strip and a uniform strip tension so that expensive automatic control systems are no longer required even if the coiled strip expands as a result of its temperature rise.

It is essential that the heat generated by eddy currents within the expanding segments can be effectively transferred to the coiled strip. An ability of the coiler mandrel to store heat is neither required nor desired. For this reason, a further feature of the invention provides that each expanding segment consists of an outer part, which carries the heating winding, and an inner part, which is cooled and is separated from the outer part by a heat-insulating layer. The provision of two parts which are heat-insulated from each other will prevent a transfer of heat through the mandrel shaft as well as a substantial temperature rise of the inner part, which faces the mandrel shaft, so that the delicate parts of the expanding mandrels, inclusive of the expanding device, will not be subjected to substantial heat loads and for this reason are not liable to fail. Besides, the grooves for receiving the heating winding can be machined in the outer part of each expanding segment by a simple milling operation. Finally, the provision of bipartite expanding segments permits the designer to allow for the thermal expansion which is due to the heating of the outer parts of the expanding segments.

This can be accomplished by supporting the outer part of each expanding segment, which outer part carries the heating winding, by spacers on the supporting inner part and holding down the outer part by tension screws. This fixation of the outer parts will not prevent their thermal expansion in the axial and circumferential directions.

In order to minimize the displacements which are due to thermal expansion, the outer part of each expanding segment may be divided along a circumferential joint. In that case the tension screws are disposed near the center of the length of each of the resulting sections so that each section is fixed at its center to the inner part and displacements will occur only in end portions.

If the spacers between the outer and inner parts are disposed along the longitudinal edges of the expanding segments, the outer parts of the expanding segments will be capable of a rather unrestrained thermal expansion so that constraints resulting in undesired deformations will be precluded. The spacers are required to take up not only a high pressure loading but should also be heat-insulating so that there will be no heat-conducting paths between the outer and inner parts of each expanding segment. This object can simply be accomplished with spacers consisting of ceramic material.

In order to prevent an excessive temperature rise of the heating winding as well as a shock loading thereof, the cooled heating winding may extend in grooves, which are lined with heat-insulating material which will also absorb mechanical shocks tending to act on the coil.

BRIEF DESCRIPTION OF THE DRAWINGS

An embodiment of the invention is shown by way of example in the accompanying drawing, in which.

DESCRIPTION OF THE PREFERRED EMBODIMENT

Figure 1:
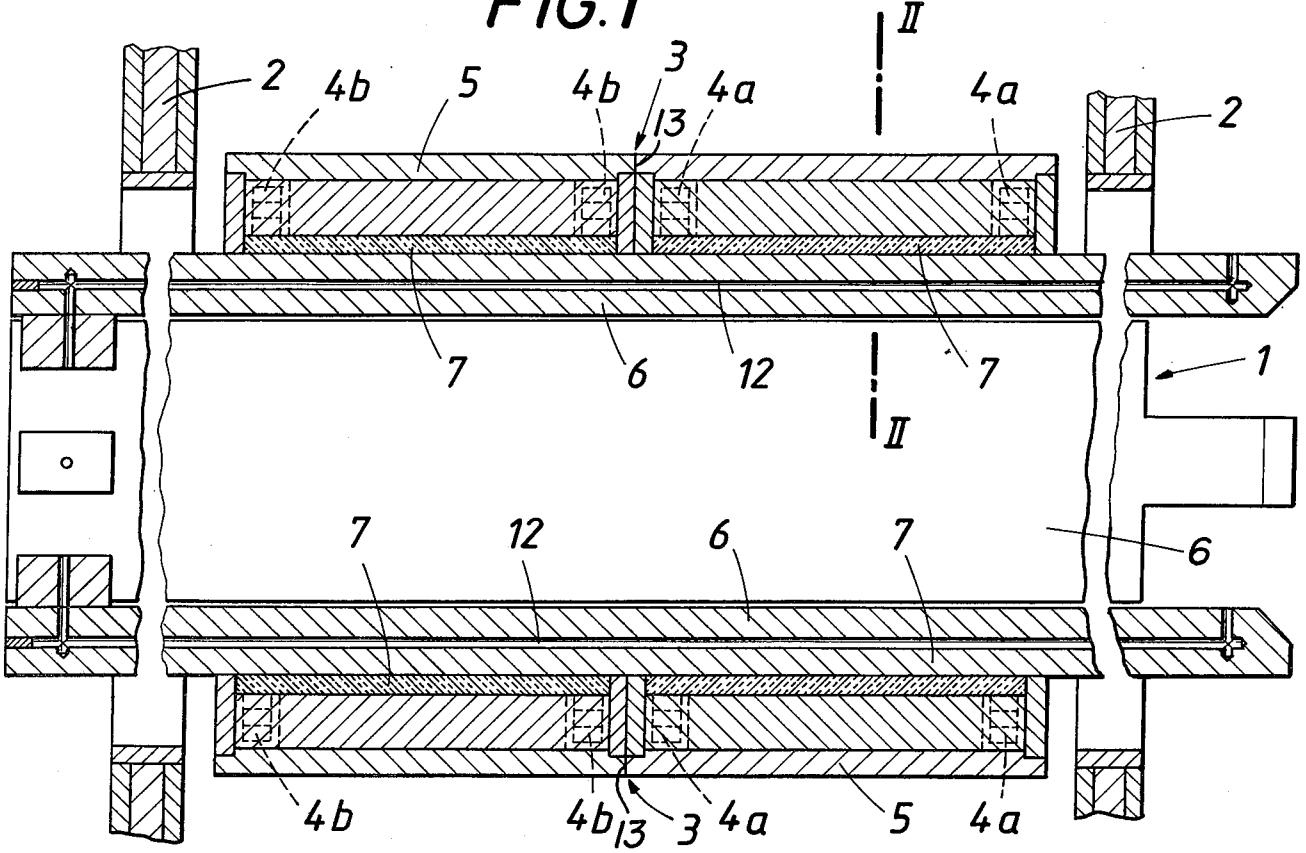
FIG. 1 is a simplified longitudinal sectional view showing a portion of a coiler-furnace adjacent to the coiler mandrel and FIG. 2 is an enlarged sectional view taken on line II—II in FIG. 1.

As is apparent from FIG. 1, the illustrated coiler-furnace combination comprises in the usual manner a coiler having a mandrel 1 which is disposed in a heat-shielding hood 2. The coiler according to the invention differs from the conventional coilers of coiler-furnaces in that it comprises an expanding mandrel having expanding segments 3, each carrying a heating winding consisting of inductor coils 4*a* and 4*b*. These inductor coils 4*a* and 4*b* are disposed in the outer part 5 of each of the expanding segments 3, which are divided into such an outer part and an inner part 6. A heat-insulating layer 7 is provided between the electrically conducting outer part 5 and the inner part 6 so that the heat generated by eddy currents in the outer part 5 cannot be dissipated through the inner part 6 to the shaft of the expanding mandrel. That shaft is not shown for the sake of clearness and is provided with the expanding device. Owing to this arrangement, the quantities of heat generated by means of the inductor coils 4*a* and 4*b* are transferred to the coiled strip so that the latter is inductively heated by means of the expanding segments 3 without causing scaling and a substantial heat loss.

The outer parts 5 are secured to the inner parts 6 by tension screws 8 which hold down the outer parts against ceramic spacers 9 disposed between the outer and inner parts 5, 6. These spacers 9 are provided adjacent to the longitudinal edges of the expanding segments 3 and permit an adequate displacement of the outer parts in response to thermal expansion. The spacers constitute also heat insulators so that they do not form heat-conducting paths.

To minimize the displacements of the outer parts 5 in response to thermal expansion, each of the outer parts 5 is divided into two halves along a circumferential joint 13 and the tension screws 8 are provided near the joint. As a result, the half sections of outer part 5 can expand to both sides from joint 13 adjacent to which they are fixed to the inner part 6. For this reason, there must be an adequate expansion joint between the half sections of the outer part.

Figure 2:
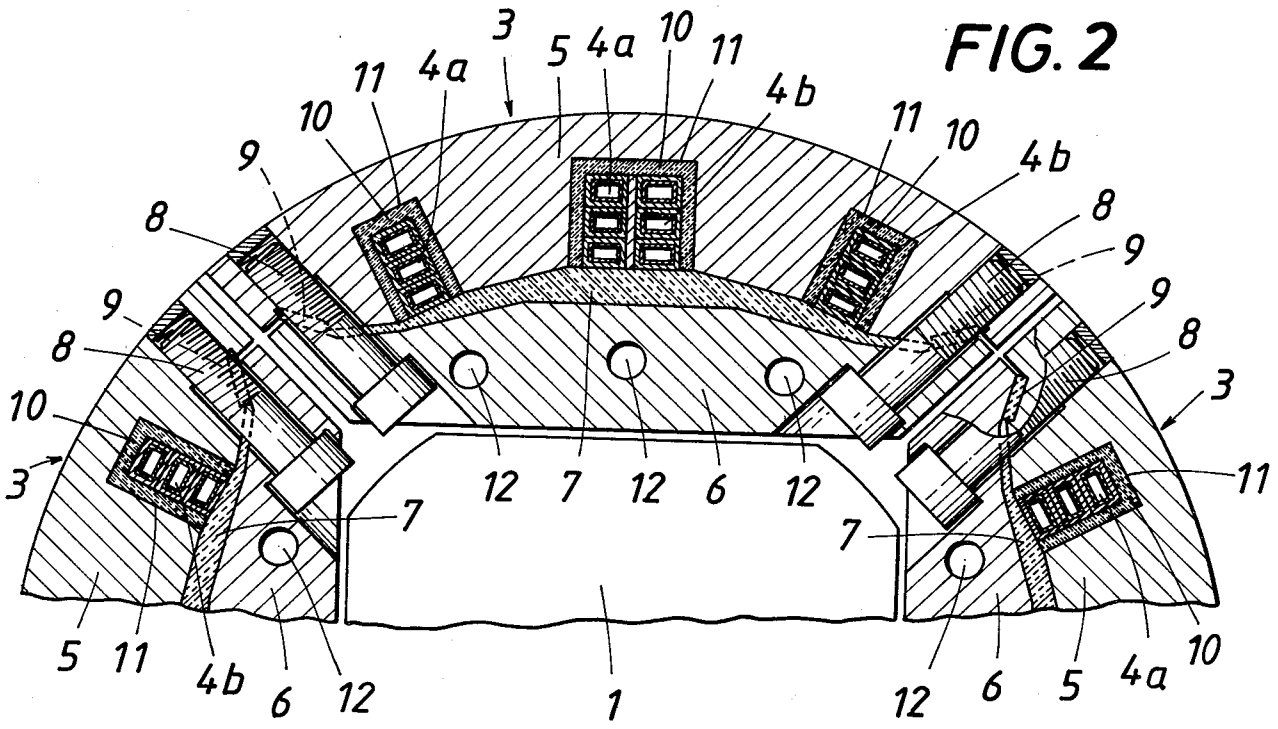

As is apparent from FIG. 2, the axis of each of the inductor coils 4*a* and 4*b* extends substantially radially with respect to the expanding mandrel and their conductors are hollow so that these conductors can be cooled by a coolant. The desired cooling of the inductor coils requires that heat insulation is provided between the conductors of the coils and the outer parts 5 of the expanding segments 3. For this reason, the conductors of the coils extend in grooves 11 which are lined with heat-insulating material 10. That heat-insulating material 10 serves also as a shock absorber and protects the conductors of the coils from excessive mechanical stress.

The inner parts 6 of the expanding segments 3 may be cooled too. For this purpose, the inner parts 6 are formed with flow passages 12 for a cooling fluid.

What is claimed is:

1. A coiler-furnace comprising a heat-shielding hood and a coiler having an expanding coiler mandrel comprising expanding segments and rotatably mounted in the heat-shielding hood for coiling a hot-rolled strip, the mandrel incorporating an electrically energizable heating winding carried by said expanding segments and comprising a plurality of inductor coils for heating the coiler strip.

2. The improvement set forth in claim 1, wherein each of said expanding segments comprises a radially outer part, a radially inner part, and a heat-insulating layer between said outer and inner parts, and said heating winding is carried by said outer parts of said expanding segments.

3. The improvement set forth in claim 2, wherein said inner part of each of said expanding segments is formed with a flow passage for conducting a cooling fluid.

4. The improvement set forth in claim 2, wherein spacers are provided between said outer and inner parts of each of said expanding segments and tension screws are provided in each of said expanding segments to hold down the outer part thereof against the associated inner part.

5. The improvement set forth in claim 4, wherein the outer part of each of said expanding segments is divided into a plurality of length sections extending along the axis of said coiler mandrel and defining between them a circumferential joint and each of said length sections is secured to the inner part of the expanding segment by tension screws disposed near the center of the length of the length section.

6. The improvement set forth in claim 4, wherein said spacers are provided between the longitudinal edge portions of said sections and said inner part.

7. The improvement set forth in claim 4, wherein said spacers consist of ceramic material.

8. The improvement set forth in claim 2, wherein said outer parts are electrically conducting.

9. The coiler-furnace set forth in claim 1, wherein said coiler mandrel is formed with grooves lined with heat-insulating material and said heating winding comprises a hollow conductor extending in said grooves.

* * * * *